US006578730B2

(12) United States Patent
Trunsky

(10) Patent No.: US 6,578,730 B2
(45) Date of Patent: Jun. 17, 2003

(54) DOG FECES COLLECTION BAG DISPENSER AND RECEPTACLE

(76) Inventor: Jane Trunsky, 2557 NW. 52nd St., Boca Raton, FL (US) 33496

( * ) Notice: Subject to any disclaimer, the term of this patent is extended or adjusted under 35 U.S.C. 154(b) by 46 days.

(21) Appl. No.: 09/928,886

(22) Filed: Aug. 13, 2001

(65) Prior Publication Data

US 2003/0029881 A1 Feb. 13, 2003

(51) Int. Cl.[7] ..... B65H 1/00

(52) U.S. Cl. ..... 221/34; 221/45; 221/102; 225/46

(58) Field of Search ..... 221/33, 34, 45, 221/46, 97, 102; 225/2, 12, 13, 15, 16, 26, 46, 53, 77, 81, 90

(56) References Cited

U.S. PATENT DOCUMENTS 2,834,506 A * 5/1958 Schaefer, Jr.
3,002,799 A * 10/1961 Kantor et al.
4,644,689 A * 2/1987 Arians ..... 221/102 X
4,706,845 A * 11/1987 Schnurer et al. ..... 221/102
4,919,302 A * 4/1990 McPherson ..... 221/34
5,219,424 A * 6/1993 Simhaee ..... 225/47
5,261,585 A * 11/1993 Simhaee ..... 225/47
5,433,363 A * 7/1995 Simhaee ..... 225/47
5,573,168 A * 11/1996 Kannankeril et al. ..... 225/106
6,076,717 A * 6/2000 Edwards et al. ..... 225/6
6,199,788 B1 * 3/2001 Simhaee ..... 225/46 X
6,230,953 B1 * 5/2001 Simhaee ..... 225/46

* cited by examiner

*Primary Examiner*—David H. Bollinger

(57) ABSTRACT

A waste bag dispenser and used bag receptacle unit for collecting animal feces comprises a container for holding and dispensing a roll of plastic film bags and a used bag disposal receptacle. A frame for attaching the unit upon a support surface holds the container above the receptacle. Bags are manually pulled out of the container and torn from the roll of bags and are used for collecting animal waste material, such as dog feces. The used bags are deposited in the waste bag receptacle which may be removed from the frame periodically for disposition of the used bags.

12 Claims, 3 Drawing Sheets

DOG FECES COLLECTION BAG DISPENSER AND RECEPTACLE

A device for storing and dispensing bags primarily intended for use in collecting dog feces and other waste material and for providing a receptacle for disposing of used bags. The device would be mounted in publicly accessible locations where individuals walking or supervising dogs, or other animals, are obliged to remove feces deposited by their animals.

BACKGROUND OF THE INVENTION

In many urban areas, local laws or ordinances or customs oblige people who are walking or otherwise supervising dogs and other pets to clean-up feces deposited by their animals. Thus, dog owners, particularly, in such areas, need to carry with them containers and such other devices as they may require for picking up and disposing of feces deposited by their animals. Where the individuals fail to carry with them, or do not have readily available to them, suitable containers or scooping devices or the like when needed, it becomes awkward and in many cases not possible for them to collect and dispose of such animal waste. Thus, efforts have been made to provide collection bags as well as trash receptacles in urban area which people may use, when necessary, for cleaning-up after their animals.

Among the prior devices proposed for this purpose are containers that hold bags which may be freely taken by an individual who is in charge of the particular animal causing the problem. An example of such an animal waste bag dispenser containing a roll of connected bags which may be used, one by one, for clean-up purposes, is disclosed in U.S. Pat. No. 5,167,377 issued Dec. 1, 1992 to A. K. Chalmers for an Animal Waste Bag dispenser. That patent discloses a roll of connected bags from which an individual bag may be torn for use is picking up animal waste. The roll is arranged upon a vertical spindle so that bags may be torn, one by one off the roll.

Once the individual responsible for the animal picks up the animals waste deposit is a bag, it is necessary to have a place to throw away the collected waste material. But, suitable trash containers are not always readily available in many urban locations. Thus, U.S. Pat. No. 6,170,691 B1, issued Jan. 9, 2001 to J. A. Johnston for an "Animal Waste Bag Dispenser And Disposal Unit" discloses a device wherein two containers are mounted upon a vertical post or pole. The lower container stores bags which may be pulled from the container, one by one, and the upper container acts as a trash receptacle for receiving used bags. This device, although simple in construction, is relatively awkward to use and, in general, is unattractive in appearance. The appearance and convenience of such a device is important since such devices are intended to be mounted and displayed in public locations, particularly in up-scale residential areas, where local residents are concerned about the neighborhood appearances.

Thus, it is desirable to provide, easy to use and easy to mount in convenient locations and, particularly, easy and inexpensive to maintain and service, waste bag dispensing equipment which provides and receives waste collection bags.

SUMMARY OF THE INVENTION

This invention contemplates a simplified support frame formed of tubing bent into an inverted U shape, whose lower end is further bent into a horizontal loop or partial circle into which a basket-like receptacle is removably held, and with a bag holding container mounted above the receptacle upon the upwardly extending legs of the frame. Preferably, the container is formed in a generally cylindrical shape, arranged horizontally, into which a roll of plastic film bags, connected end to end, is loosely inserted. The outermost bag is extended downwardly and outwardly of the container through a slot so that the user of a bag may simply grasp the outermost bag and pull it outwardly of the container and tear it free from the roll. To simplify the separation of the outermost bag of its next interior bag, the adjacent ends of the bags are connected together along a tear line. A space is formed along the middle portion of the tear line. The container has a supporting plate or shelf located beneath the slot upon which the bags rest, as they are withdrawn from the slot. Upwardly extending tabs on the plate fit into the space between the outer most bag and its next bag. The tabs engage the leading edge of, the next to the outermost bag so that when the outermost bag is pulled to tear it free, the tabs hold the next bag against movement. That enables the tearing to be conducted with one hand.

The roll located in the generally cylindrically shaped bag container is replenished when the roll is completed used by inserting a new roll endwise into the end of the horizontal container. Preferably, the slot in the container extends longitudinally of the axis of the container and opens at one or both of the ends of the container. Thus, it is convenient to slide the outermost bag on the new roll into the slot as the roll is slid longitudinally into the container. A removable end cap plugs the open end of the container for keeping the roll in position in the container until it is used up and, also, for permitting opening the end of the container for inserting a new roll.

By loosely suspending the bag disposal basket or receptacle from the lower loop-formation of the frame, the receptacle may be lifted up for removal and emptied periodically. To protect the receptacle, a suitable lid is hingedly connected upon the frame to cover the opening of the receptacle. Thus, this invention contemplates an essentially closed, and therefore, protective, container for the roll of bags and similarly, a protected trash basket for receiving and holding used bags until the receptacle is emptied.

An object of this invention is to provide a simplified, relatively attractive, unit to perform the functions of making a waste collection bag readily available and simultaneously providing a convenient place to dispose of the used bag. By forming such a complete unit with a simplified mounting frame, that provides a supply bag and the means for collection of the used bags, the unit can be easily and quickly mounted on supports at desired areas and can be easily maintained or serviced.

A further object of this invention is to provide a bag holder, particularly for use in providing thin, plastic, film bags in a roll form for disconnecting the bags one by one for removal from the roll, with a simple mechanical device which cooperates with the structure of the bag to enable the bags to be torn apart with one hand. This is particularly useful in situations where the individual accompanying the animal which is involved, to hold the leash of the animal with one hand while pulling a bag from its container with the opposite hand.

Yet a further object of this invention is to provide a unit which can be serviced or maintained with respect to replenishing used up rolls of bags and disposing of used bags, quickly and easily. The collected, used bags placed in the disposal receptacle can be easily removed by ordinary trash collection services so that the local municipality or local area service people can maintain the unit without difficulty.

These and other objects and advantages of this invention will become apparent upon reading the following description of which the attached drawings form a part.

DETAILED DESCRIPTION

Figure 1:
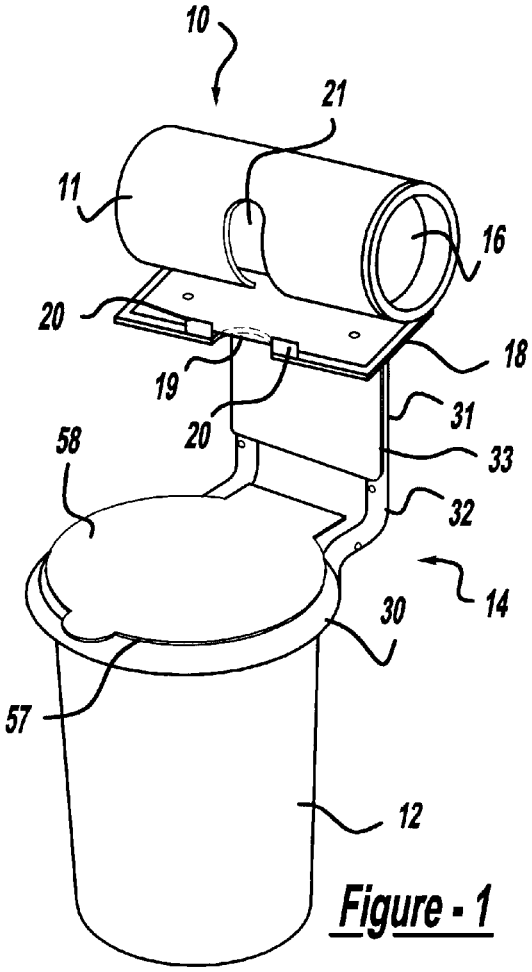
FIG. 1 is a perspective view of the complete unit shown from the front, left side thereof.
Figure 2:
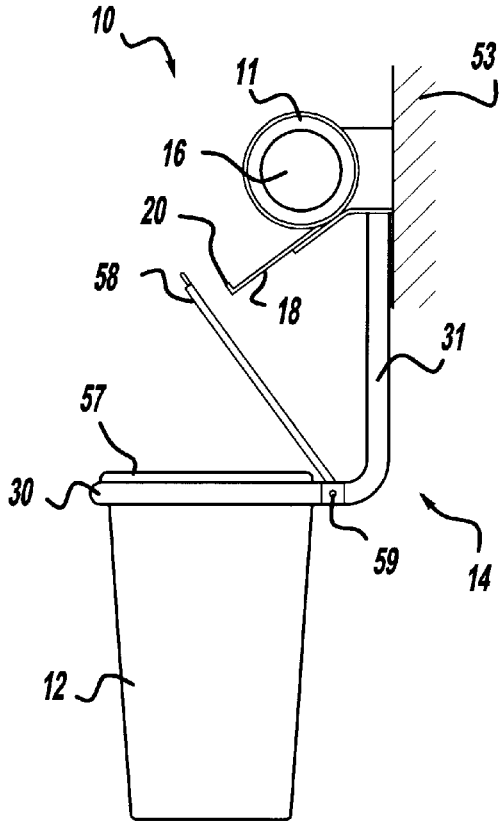
FIG. 2 is an elevational view of the unit with the lid partially opened.
Figure 3:
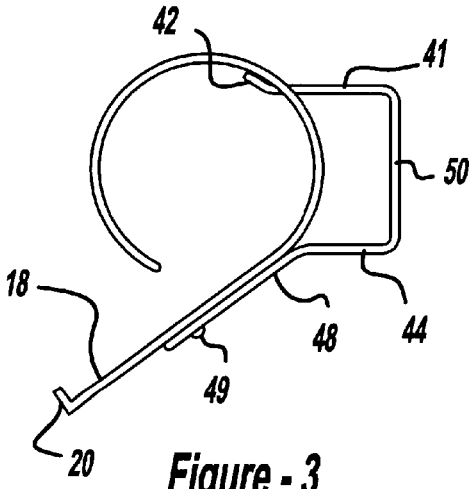
FIG. 3 is an enlarged, end view of the bag container.
Figure 5:
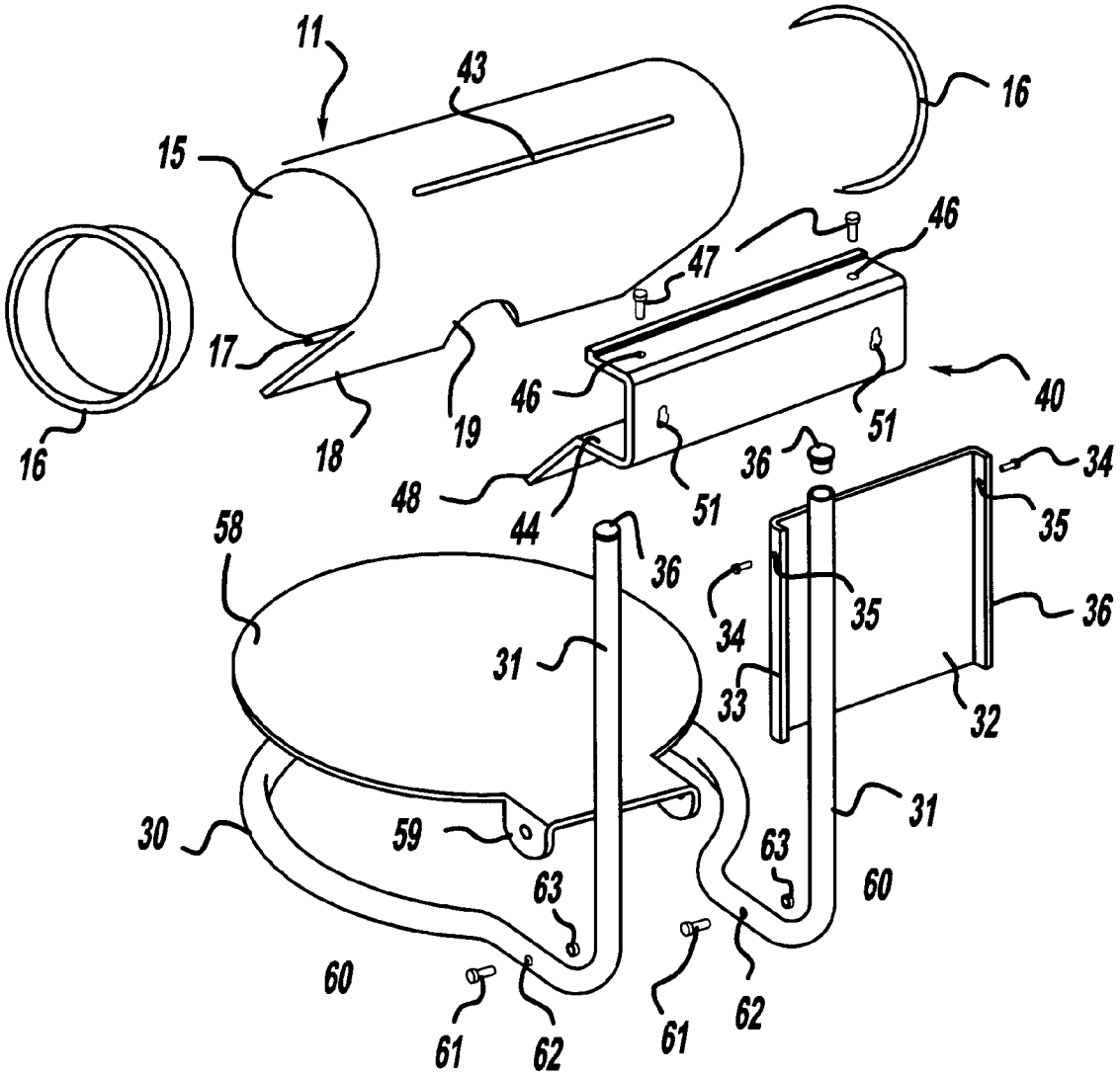
FIG. 5 is a perspective, disassembled view of the parts forming the unit, with the view taken from the rear, left side of the unit.

The bag dispenser and used bag collection unit 10, as illustrated in FIGS. 1 and 5, include a bag container 11, which is located above a used bag collection receptacle 12, and a frame 14 which holds the container and receptacle. The container 11 is preferably in a generally cylindrical shape arranged with its axis approximately horizontally. The opposite open ends 15 of the container are closed by end caps 16 which form plugs that close the opposite ends of the cylinder.

A horizontal slot 17 is formed in the lower, longitudinal edge of the cylinder. The slot extends to at least one end of the cylinder. The cylinder is extended, from the lowermost longitudinal edge of the slot, to provide a shelf or plate 18. A central notch or recess 19 is formed in the plate and upwardly extending tabs 20 are formed on the opposite sides of the recess 19. Further, a cut-out opening 21 is made in the forward, central, area of the cylinder.

Figure 6:
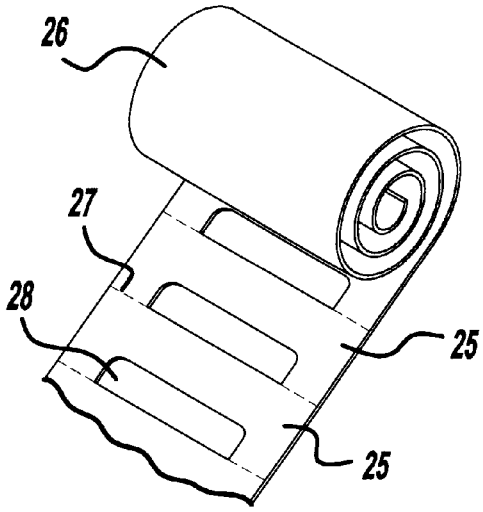
FIG. 6 illustrates a roll of the bags with the outermost bag and the next two bags unrolled.
Figure 7:
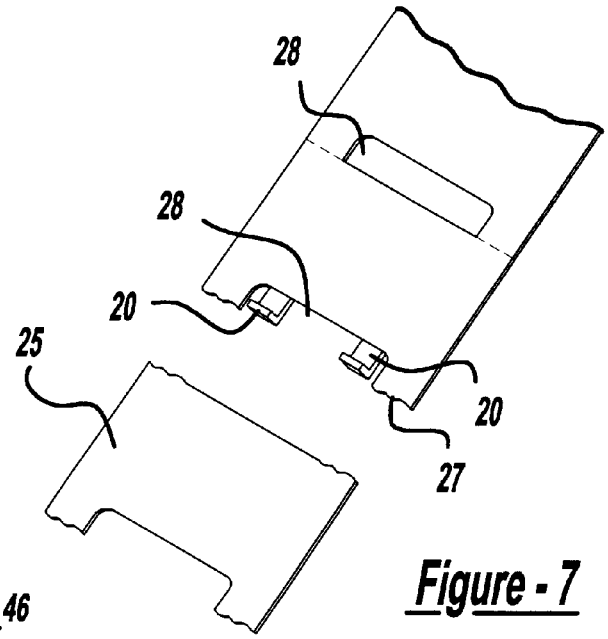
FIG. 7 is an enlarge fragmentary view of the outermost and next bags with the torn connection between the two bags.
Figure 8:
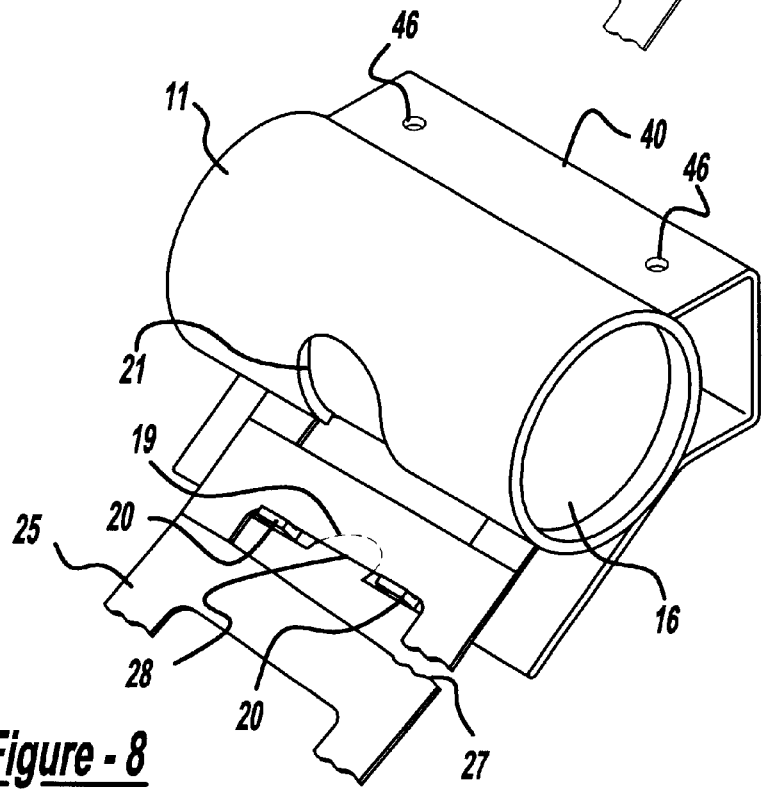
FIG. 8 is a perspective view of the bag container with the outermost and next to outermost bags exposed and partially torn apart.

The bags 25 that are intended for use with the unit 10, are preferably formed of thin, plastic film wound into a roll 26. The bags are connected together, end to end, along a tear line to form a tearable joint 27 between each bag and its next bag. A gap or space 28 is provided in at least one of the bags in the enctral area of the tearable joint. The bag arrangement is illustrated particularly in FIGS. 6 and 7 which show that the tearable joint is actually formed in two separate parts, one part on each side of the space or gap 28.

The frame 14 preferably is formed of a rigid tubular material that is bent into a generally U-shape with the lower portion bent into a generally horizontal plane to form a lower loop 30. (see FIG. 5) The frame extends upwardly into a pair of parallel arms 31. The arms are connected together by a connection panel or plate 32. To effect the connection, the opposite vertical edges of the panel are bent into rearwardly extending flanges 33 that engage the arms 31. Screws 34 pass through holes 35 formed in the flanges and enter the upper portions of the arms 31.

Figure 4:
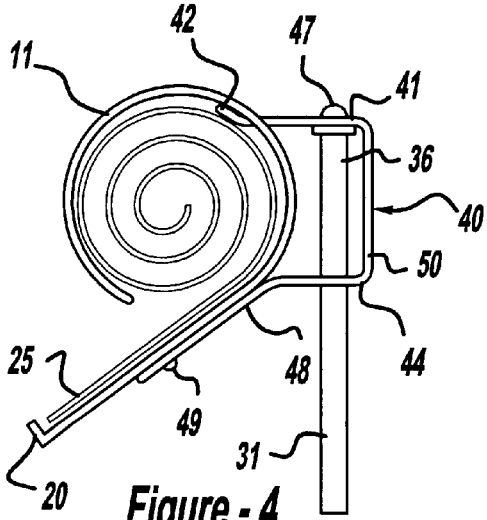
FIG. 4 is a view similar to FIG. 3, but showing the container, with a roll of bags therein, connected to the upper portions of the arms of the support frame of the unit.

The upper ends of the tubular arms are closed by suitable end plugs 36 (see FIGS. 4 and 5).

A U-shaped or channel shaped mounting bracket 40 is provided for connecting the unit to a supporting wall structure. The bracket (see FIG. 5) includes an upper, horizontal flange 41 whose free end is bent into a generally vertical direction to form a flange 42 that fits into a slot 43 formed in the container 11.

The bracket has a lower edge flange 44 having holes 45 into which the upper ends of the arms 31 are arranged. Holes 46 in the upper flange 42 receive screws 47 that engage the plugs 36 that are securely held within the upper ends of the tubular arms 31. The plugs may be held by friction or by screw threading the exterior of the plugs and the interior of the arms or by other suitable mechanical fasteners.

The lower edge flange 44 terminates in a bent, angularly directed edge flange 48 that is connected to the support plate 18 of the cylinder by rivets 49, or other conventional mechanical fasteners, to the plate 18 of the cylinder 11.

The vertical face 50 of the bracket 40 is provided with bayonet slots 51 for engaging screws 52 (see FIG. 4) that maybe located in and extended outwardly from a fixed support surface 53, such as a wall or panel or the like. Alternatively, metal straps (not shown) may be wrapped around a pole and be formed with suitable projections for engaging within the bayonet slots 51.

The disposal receptacle 12 is provided with a lip 57 around its upper edge. The receptacle is dropped into the loop 30 and is supported on the loop by the lip 57. Thus, the receptacle may be dropped into the loop quickly and easily and conversely, removed therefrom by simply pushing it upwardly out of the loop for emptying the contents, that is, the used bags deposited in the receptacle.

In order to protect the receptacle from rain or from any other disturbances, a lid 58 is arranged to fit over and cover the upper, open, end of the receptacle. For that purpose, hinge tabs 59 are formed in the opposite, rear edges of the lid. Washers 60 (see FIG. 5) are arranged against these hinge tabs and bolts 61 extend through the tabs and washers and into holes 62 in the frame. Conventional nuts 63 are provided for engaging the bolts and securing the lid rotatably relative to the frame.

This invention may be further developed within the scope of the following claims. Thus, the foregoing description should be read as being merely illustrative of an operative embodiment of this invention and not in a strictly limiting sense.

I now claim:

1. A waste collection bag dispenser and receptacle unit comprising;

a bag container for holding plastic film bags and having an opening through which bags may be removed from the container;

plastic film bags normally positioned within the container, with a bag normally accessible through the opening for hand grasping and pulling the bag from the container for use;

a waste bag collection receptacle within which used bags are deposited;

a support frame having an upper portion upon which said container is mounted and a lower portion upon which the receptacle is removably mounted;

a connector on the frame for rigidly attaching the unit upon a stationary support;

whereby the unit may be normally attached upon a support in a place where a bag user may manually pull a bag from the container and use the bag for collecting waste material, such as dog feces and other animal waste materials, and may thereafter deposit the used bag in the receptacle for subsequent disposal of the used bags collected within the receptacle.

2. A waste collection bag dispenser and receptacle unit as defined in claim 1 and including said bags being connected together end to end and formed into a roll of bags;

said roll being generally horizontally arranged within the container and having an outermost bag extended through the opening;

and said bags being connected together by a tearable joint, so that the outermost bag in the roll may be manually pulled and torn free from the next bag to which it is connected.

3. A waste collection bag dispenser and receptacle unit as described in claim 2, and said container opening being formed as an elongated, horizontally extending slot through which the bags may be pulled;

and a shelf-like bag support formed on the container along the opening and depending downwardly from the container for supporting the outermost bag and a portion of the next bag connected to the outermost bag, as the outermost bag is pulled from the container.

4. A waste collection bag dispenser and receptacle as defined in claim 3, and including the bags having a normally horizontally elongated gap formed along the tearable joints between the bags;

and the shelf-like having at least one upwardly extending tab located to extend into the gap between the outermost and next bags for engaging the next bag;

whereby when the outermost bag is torn from the next bag along the tearable joint therebetween, the tab momentarily holds the next bag against movement to facilitate tearing apart the bags along the tearable joint.

5. A waste collection bag dispenser and receptacle unit comprising;

a horizontally arranged container for holding plastic film bags and having an opening through which individual bags may be removed from the container;

a roll formed of plastic film bags connected together end to end, normally positioned within the container with an outermost bag of the roll normally protruding through the container opening for hand gripping and tearing the outermost bag free from the roll for use;

a waste bag collection receptacle within which used bags may be deposited;

a support frame having an upper portion upon which said container is mounted and a lower portion upon which the receptacle is mounted;

a connector on the frame of the unit for rigidly attaching the unit upon a stationary support;

whereby the unit may be normally attached upon a support at a location where a bag user may manually pull a bag from the container and use the bag for collecting waste material, such as dog feces or other such animal waste, and may deposit the used bag in the receptacle for subsequent disposal of the used bags collected in the receptacle.

6. A waste collection bag dispenser and receptacle unit as defined in claim 5, and said receptacle being removably supported upon the frame for removal therefrom;

and the receptacle having an open top with a lid normally covering the open top, and said lid being manually openable for depositing used bags in the receptacle.

7. A waste collection bag dispenser and receptacle unit as defined in claim 6, and said frame comprising a tubular strip formed with a bent lower loop, horizontally arranged, within which the receptacle is arranged and supported, and a pair of generally parallel upwardly extending arms upon which the container is mounted.

8. A waste collection bag dispenser and receptacle unit as defined in claim 5, and with the bags forming the roll of bags being connected together, end to end, by a tearable joint, so that the outermost bag in the roll may be manually pulled downwardly and outwardly and thereby, torn free from the next bag to which is it connected.

9. A waste collection bag dispenser and receptacle unit as defined in claim 8, and wherein said container opening is formed of a elongated, horizontally extending slot, through which the outermost bag may be pulled;

and a bag support plate on the container, arranged along the opening therein, and extending downwardly at an angle from the vertical, from the container for supporting the outermost bag and a portion of the next bag to which the outermost bag is connected, when the outermost bag is pulled through the opening from the container.

10. A waste collection bag dispenser and receptacle unit as defined in claim 9, and with the bags each having a normally horizontally elongated space formed adjacent the tearable joint with the next adjacent bag, so that the tearable line extends on both sides of the space;

and the bag support plate having at least one upwardly extending tab located to extend into the space between the outermost and next bags for engaging the next bag;

whereby the outermost bag is torn from the next bag along the tearable joint there between, and the tab momentarily holds the next bag against movement to facilitate the tearing apart of the bags.

11. A bag dispenser for dispensing bags, one by one, from a roll of bags comprising of;

an elongated container having a normally, horizontally oriented axis and a horizontally extending, elongated slot;

a roll of thin film bags, connected together end to end, to form a roll, located within the container with the roll having a central axis coaxial with the container axis and having its outermost bag normally extending through said slot;

a support plate secured to and depending from the container along the length of said slot for supporting the bag outwardly of the slot, so that the bag slides upon the plate as the bag is pulled out of the container;

the shelf having an outer edge with at least one upwardly extending tab formed on said outer edge;

the bags each having their connected ends joined by a manually tearable joint and having a normally horizontally extending, open space formed centrally of the joint with the next adjacent bag;

and said tab being positioned to fit within the space between the outermost bag and the next bag connected to the outermost bag, when the outermost bag is pulled completely outwardly of said slot, so that the tab momentarily holds the next bag to the outermost bag against movement in a direction outwardly of the container so that the outermost bag may be manually pulled and torn free from the next bag to which is it connected along the tearable joint between the outermost bag and its next connected bag.

12. A bag dispenser as defined in claim 11, and wherein the plate extends downwardly at an acute angle to the horizontal and has an upper surface over which bags pulled from the container slot slide, and at least two upwardly extending spaced apart tabs formed on the outermost edge of the plate for entering into the space between the outermost and the next bag to which the outermost bag is connected, and engaging the next bag to prevent it from moving along with the outermost bag when the outermost bag is manually torn from its next connected bag.

* * * * *